US009464617B2

(12) United States Patent
Fujishiro et al.

(10) Patent No.: US 9,464,617 B2
(45) Date of Patent: Oct. 11, 2016

(54) GLOW PLUG DRIVING CONTROL APPARATUS

(71) Applicant: Bosch Corporation, Tokyo (JP)

(72) Inventors: Yoshihito Fujishiro, Saitama (JP); Tomohiro Nakamura, Saitama (JP); Yutaka Tanaka, Saitama (JP)

(73) Assignee: Bosch Corporation, Tokyo (JP)

( * ) Notice: Subject to any disclaimer, the term of this patent is extended or adjusted under 35 U.S.C. 154(b) by 243 days.

(21) Appl. No.: 14/368,919

(22) PCT Filed: Nov. 5, 2012

(86) PCT No.: PCT/JP2012/078569

§ 371 (c)(1),
(2) Date: Jun. 26, 2014

(87) PCT Pub. No.: WO2013/099439

PCT Pub. Date: Jul. 4, 2013

(65) Prior Publication Data

US 2014/0331955 A1 Nov. 13, 2014

(30) Foreign Application Priority Data

Dec. 27, 2011 (JP) ..... 2011-286227

(51) Int. Cl.
*F02P 19/02* (2006.01)
*H05B 1/02* (2006.01)
*F23Q 7/00* (2006.01)

(52) U.S. Cl.
CPC ..... *F02P 19/026* (2013.01); *F02P 19/02* (2013.01); *F02P 19/021* (2013.01); *H05B 1/0236* (2013.01); *F02P 19/022* (2013.01); *F02P 19/023* (2013.01); *F23Q 7/001* (2013.01)

(58) Field of Classification Search
CPC .... F02P 19/021; F02P 19/022; F02P 19/023; F02P 19/025; F02P 19/026; F02P 19/027; F02P 19/028; F02P 19/02; H05B 1/0236
USPC ..... 123/145 A, 179.6
See application file for complete search history.

(56) References Cited

U.S. PATENT DOCUMENTS 4,106,465 A * 8/1978 Bernhardt ..... F02P 19/02 123/179.21
4,285,307 A * 8/1981 Steinke ..... F02P 19/02 123/145 A (Continued)

FOREIGN PATENT DOCUMENTS

JP 55-12292 1/1980
JP 6035177 A * 2/1985 ..... F02P 19/021

(Continued)

OTHER PUBLICATIONS

International Search Report for Application No. PCT/JP2012/078569 dated Jan. 8, 2013 (English Translation, 2 pages).

*Primary Examiner* — Stephen K Cronin
*Assistant Examiner* — Kevin R Steckbauer
(74) *Attorney, Agent, or Firm* — Michael Best & Friedrich LLP

(57) ABSTRACT

A glow plug driving control apparatus. The glow plug driving control apparatus includes a glow switch 2 and a glow plug 1 which are connected in series between a power supply and ground, and an electrical controlling unit 101 which controls opening and closing of the glow switch 2, and that can perform energization driving of the glow plug 1. The glow plug driving apparatus also includes an energization path switching switch 5 that connects in series a stability coil 3 in a serial connection path of the glow switch 2 and the glow plug 1 at the time of an energization start of the glow plug 1, and after the energization start, causes both the glow switch 2 and the glow plug 1 to return to a serial connection state between the power supply and the ground.

4 Claims, 4 Drawing Sheets

(56) References Cited

U.S. PATENT DOCUMENTS 4,348,583 A * 9/1982 Bube ..... H05B 1/0236
123/179.21
4,500,775 A * 2/1985 Sangu ..... F02P 19/027
123/145 A
4,701,596 A * 10/1987 Schirmer ..... B60Q 11/00
123/179.21

FOREIGN PATENT DOCUMENTS

JP 03113519 5/1991
JP H03113519 5/1991
JP 0942135 A * 2/1997 ..... F02P 15/00
JP 1198683 4/1999
JP 2003120932 4/2003
JP 200913983 1/2009
JP 2010270961 12/2010

* cited by examiner

S204: COIL CONNECTION AND DRIVING START

S206: DRIVING TRANSITION CONDITION IS SATISFIED?

S208: COIL OPENING (A)

(B)

GLOW PLUG DRIVING CONTROL APPARATUS

BACKGROUND OF THE INVENTION

The present invention relates to a glow plug driving control method and a glow plug driving control apparatus which are mainly used for a starting aid of a diesel engine, and particularly to a glow plug driving control method and a glow plug driving control apparatus for a current variation reduction or the like.

As an energization method with respect to a glow plug used for a starting aid of a diesel engine for a vehicle, it is common to use a pulse width modulation (PWM) that has an advantage of a small power loss at the time of a voltage control and of flexible voltage setting or the like based on an effective voltage, and various driving control methods and apparatuses, based on such a pulse width modulation, have been proposed and put into practical use (for example, refer to JP-A-2009-13983).

However, when the driving control based on the effective voltage is applied to the glow plug, a current variation according to a voltage variation is also produced. Since a power dissipation of the glow plug is high, the current variation according to the voltage variation also becomes large. The current variation may reach several tens of amperes at the time of a peak. There occurs problems that electrical stress due to the current variation of a heater portion is applied, and expedited deterioration of the glow plug is caused, and that lead to a short life.

SUMMARY OF THE INVENTION

The present invention is made in view of the above-described circumstances, and provides a glow plug driving control apparatus which can suppress a current variation at the time of a driving start and can achieve a long life with a reduction of electrical stress due to the current variation.

According to an embodiment of the present invention, there is provided a glow plug driving control apparatus that has a glow switch and a glow plug which are connected in series between a power supply and ground, and an electrical controlling unit which controls opening and closing of the glow switch, and that can perform energization driving of the glow plug, including an energization path switching switch that connects in series a current stability element in a serial connection path of the glow switch and the glow plug at the time of an energization start of the glow plug, while after the energization start, causes both the glow switch and the glow plug to return to a serial connection state between the power supply and the ground, according to a control of the electrical controlling unit.

According to the present invention, at the time of an energization start to a glow plug, a current stability element is inserted in series in an energization path of the glow plug, while after the energization start, the current stability element is excluded from the energization path of the glow plug under a specific condition. Accordingly, at the time of an energization driving start, a current flowing to the glow plug is smoothed, and unlike the related art, a large momentary current is prevented from flowing at the time of the driving start. Thus, there are advantages in which electrical stress with respect to the glow plug is reliably reduced, a long life of the glow plug can be obtained, power dissipation is reduced, and power saving of the apparatus can be achieved.

In addition, since the large momentary current is prevented from occurring at the time of the driving start of the glow plug, a noise is suppressed from occurring, a negative influence of a false operation or the like of a neighboring electronic circuit caused by the noise can be reduced or suppressed, and an apparatus with a higher reliability can be provided.

BRIEF DESCRIPTION OF THE DRAWINGS

FIG. 1(A) is a circuit diagram before a driving start of a glow plug is performed, and FIG. 1(B) is a circuit diagram in which path switching is performed after the driving start of the glow plug.

FIG. 3(A) is a waveform diagram schematically illustrating the current variation of the glow plug immediately after a driving start, and FIG. 3(B) is a waveform diagram schematically illustrating the current variation of the glow plug when path switching is performed after the driving start.

FIG. 4(A) is a circuit diagram before driving start of a glow plug is performed, and FIG. 4(B) is a circuit diagram in which path switching is performed after the driving start of the glow plug.

DETAILED DESCRIPTION

Description of Reference Numerals and Signs

Figure 1:
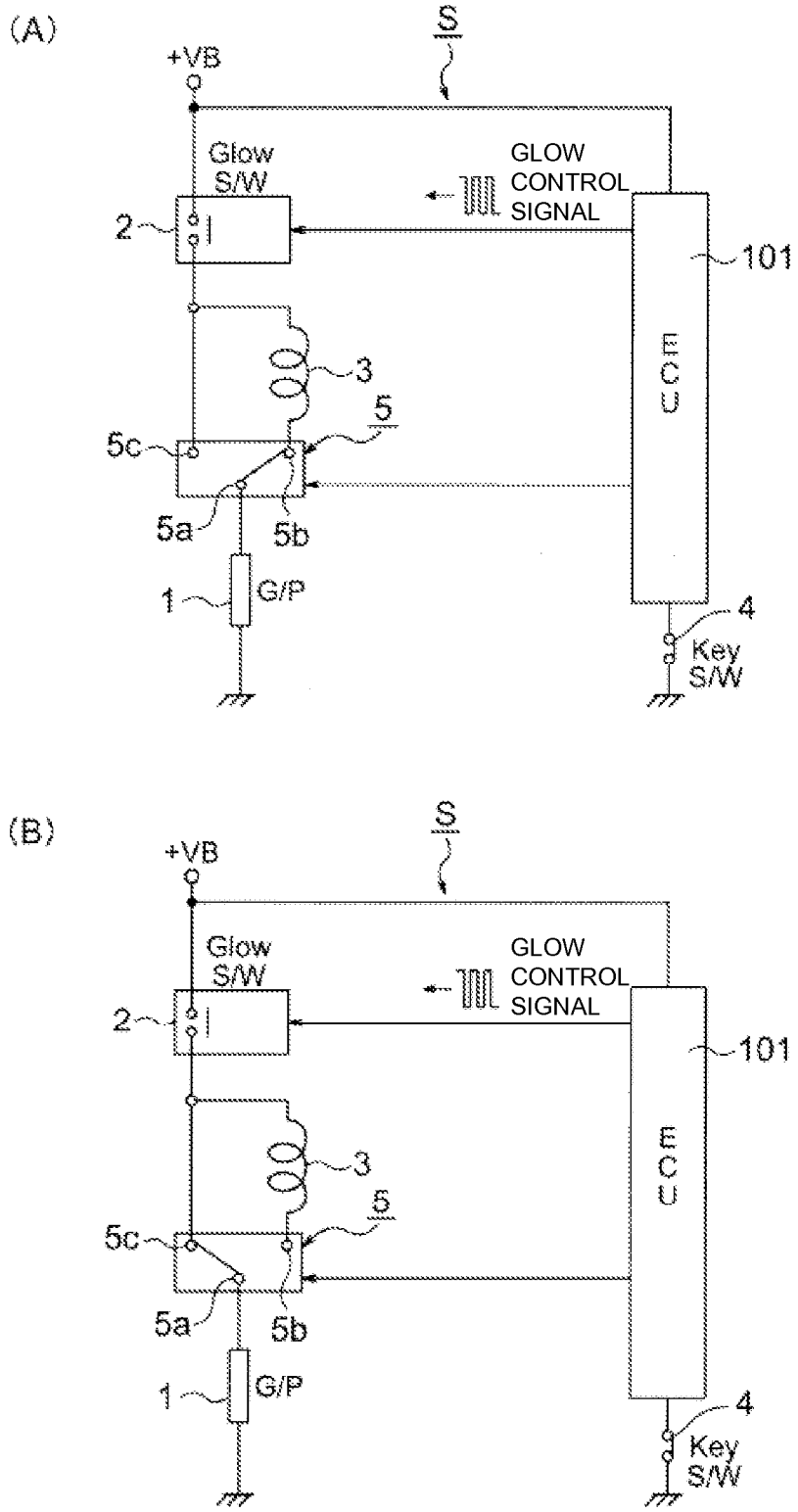
FIG. 1 is a circuit diagram illustrating a first circuit configuration example of a glow plug driving control apparatus according to an embodiment of the present invention.

1: glow plug
2: glow switch
3: stability coil
5: energization path switching switch (first configuration example)
6: energization path switching switch (second configuration example)
101: electrical controlling unit Hereinafter, embodiments of the present invention will be described with reference to FIGS. 1 to 4.

Members, arrangements or the like described below do not limit the present invention, and can be modified in various ways without departing from the spirit of the present invention.

A first configuration example of a glow plug driving control apparatus according to an embodiment of the present invention illustrated in FIG. 1 will be described first.

The glow plug driving control apparatus S according to the embodiment of the present invention is configured to have an electrical controlling unit (referred to as "ECU" in FIG. 1) 101, a glow switch (referred to as "Glow S/W" in FIG. 1) 2, a stability coil 3 as a current stability element, and an energization path switching switch 5, as main configuration elements.

For example, the electrical controlling unit 101 is configured to include a micro-computer (not illustrated) with a publicly known or well known configuration as a main component, a memory element (not illustrated) such as a RAM or a ROM, and an input and output interface circuit (not illustrated) or the like for a signal transmission and reception with an external circuit, and performs an engine control, a fuel injection control or the like of a vehicle, and a glow plug driving control process described later. Such an electrical controlling unit 101 generates and outputs a so-called pulse width modulation (PWM) signal as a glow control signal for on and off of the glow plug 1.

The glow switch 2 performs an on and off operation according to the above-described control signal (PWM signal) output from the electrical controlling unit 101, and more specifically, for example, is configured to have a semiconductor element such as a field effect transistor as a main configuration element. The configuration thereof is the same as that of the related art.

Such a glow switch 2 has terminals which are opened and closed, one terminal (for example, a drain of the field effect transistor) of the terminals is connected to a vehicle battery which is not illustrated, and a battery voltage VB is applied to the one terminal, while the other terminal (for example, a source of the field effect transistor) of the terminals which are opened and closed, is connected to one terminal of the stability coil 3.

Then, the other terminal of the stability coil 3 is connected to a second contact point 5*b* of the energization path switching switch 5 described later.

In addition, a connection point between the glow switch 2 and the one terminal of the stability coil 3 is connected to a third contact point 5*c* of the energization path switching switch 5.

The energization path switching switch 5 is a single throw double pole switch which has one-circuit-two-contact-point, that is, first to third contact points 5*a* to 5*c*, and is configured in such a manner that according to a switching control signal from the electrical controlling unit 101, the first contact point 5*a* is selectively connected to any one of the second contact point 5*b* and the third contact point 5*c*.

For example, such an energization path switching switch 5 is configured to have a semiconductor element such as a field effect transistor as a main configuration element.

The energization path switching switch 5 according to the embodiment of the present invention becomes a connection state between the first contact point 5*a* and the second contact point 5*b* (refer to FIG. 1(A)), in a normal state, that is, in a state where any control signal is not applied from outside.

Then, when a predetermined switching control signal is applied from the electrical controlling unit 101, the first contact point 5*a* and the third contact point 5*c* are connected together.

In the embodiment of the present invention, a glow plug (denoted by "G/P" in FIG. 1) 1 is connected in series between the first contact point 5*a* and the ground (Refer to FIG. 1(A)).

In addition, the electrical controlling unit 101 and an ignition switch (denoted by "key S/W" in FIG. 1) 4 are sequentially connected in series, when viewed from a vehicle battery side, between a vehicle battery which is not illustrated and the ground, and by turning on (closed state) the ignition switch 4, a battery voltage VB is applied to the electrical controlling unit 101.

Next, the glow plug driving control process which is performed by the electrical controlling unit 101 in such a configuration will be described with reference to a subroutine flow chart illustrated in FIG. 2.

Figure 2:
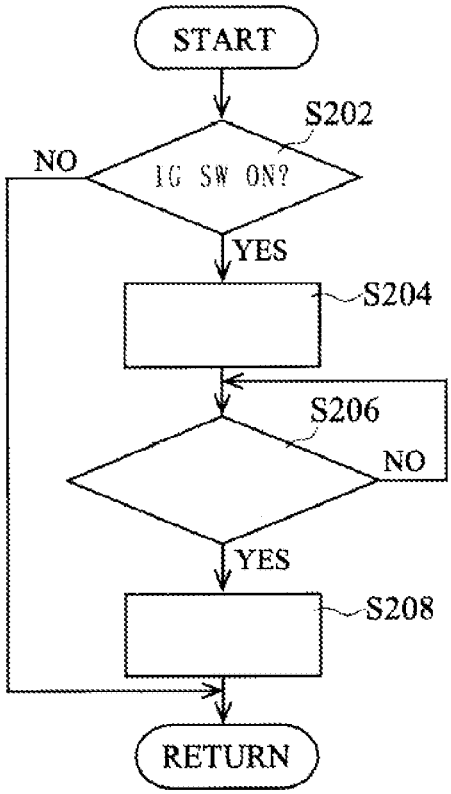
FIG. 2 is a subroutine flow chart illustrating a sequence of a glow plug driving control process performed by an electrical controlling unit configuring the glow plug driving control apparatus illustrated in FIG. 1.
Figure 3:
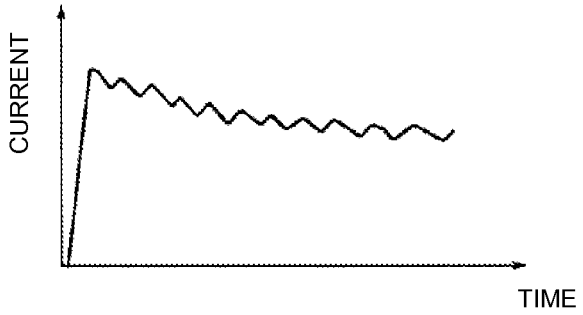
FIG. 3 is a waveform diagram illustrating a current variation at the time of driving of a glow plug performed by the glow plug driving control apparatus illustrated in FIG. 1.
Figure 3:
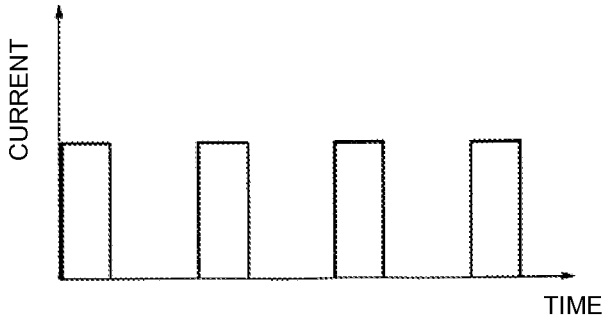

When the process is started by the electrical controlling unit 101, it is determined whether the ignition switch 4 is ON or not, at an initial time (refer to step S202 of FIG. 2).

In step S202, in a case where it is determined that the ignition switch 4 is ON (in a case of YES), the step proceeds to a process of step S204 described later as driving start (energization start) of the glow plug 1, and in a case where it is determined that the ignition switch 4 is not ON (in a case of NO), a series of processes ends while determining that the glow plug 1 is not to be driven, and the step returns once to a main routine not illustrated.

In step S204, the glow switch 2 is connected to the glow plug 1 via the stability coil 3, and the glow plug 1 becomes the energization start according to the PWM control signal.

That is, in the embodiment of the present invention, as previously described, the energization path switching switch 5 has the first contact point 5*a* and the second contact point 5*b* which are connected together in the normal state. For this reason, in step S204 that becomes the energization start of the glow plug 1, the switching control signal is not transmitted from the electrical controlling unit 101 to the energization path switching switch 5, a connection state between the first contact point 5*a* and the second contact point 5*b* is maintained, and the glow switch 2, the stability coil 3, the energization path switching switch 5, and the glow plug 1 are connected in series between the vehicle battery which is not illustrated and the ground (refer to FIG. 1(A)).

Then, the PWM control signal is transferred from the electrical controlling unit 101 to the glow switch 2 in the same way as the related art, and thereby the battery voltage VB is applied to the glow plug 1 via the glow switch 2, the stability coil 3, and the energization path switching switch 5, and the energization is performed according to the PWM control signal.

Thus, immediately after the energization start of the glow plug 1, a large momentary current does not flow at the time of the energization start in the glow plug 1 by an operation of the stability coil 3, but an approximately smoothed current flows, as schematically illustrated in FIG. 3(A).

Subsequently, the step proceeds to a process of step S206, and it is determined whether a driving transition condition is satisfied or not.

That is, in an energization state to the glow plug 1 via the stability coil 3, it is determined whether a predetermined condition for applying the battery voltage VB to the glow plug 1 without passing through the stability coil 3 is satisfied or not.

As the specific driving transition condition, for example, a predetermined elapsed time from the energization start can be provided. That is, it is preferable to determine whether a predetermined time has elapsed or not from the energization start, and in a case where it is determined that the predetermined time has elapsed, the battery voltage VB is applied to the glow plug 1 without passing through the stability coil 3, while determining that the driving transition condition is satisfied.

In this case, for example, it is also preferable that the predetermined elapsed time be changed by a driving state of an engine (not illustrated).

More specifically, for example, engine coolant temperature is set as a parameter indicating an engine driving state, and relationships between various engine coolant temperatures and a predetermined elapsed time appropriate for each engine coolant temperature are obtained based on a test, a simulation result or the like, the relationships are mapped, and the maps are stored in an appropriate storage area of the electrical controlling unit 101. Then, at the time of implementation of step S206, the predetermined elapsed time according to the engine coolant temperature may be read from the above-described map, and it may be determined whether the driving transition is performed or not by using a appropriate predetermined elapsed time.

In addition, the driving transition condition is not limited to this, but it is preferable that appropriate condition be selected depending on various specific conditions of the vehicle.

For example, accumulated energy which is energy spent in the driving from the energization start of the glow plug 1 may be used as other driving transition condition, and the satisfaction of the driving transition condition may be determined based on whether the accumulated energy exceeds a predetermined value or not.

That is, the accumulated energy of the glow plug 1 takes various expressions, but for example, if an application voltage to the glow plug 1 is set as Vg and an elapsed time from the energization start is set as t, as one of the expressions, the accumulated energy Eg can be represented as $Eg=Vg^2\times t$. Here, the Vg is an effective value (Root Mean Square).

In addition, if the application voltage to the glow plug 1 is set as Vg and an energization current of the glow plug 1 is set as Ig, the accumulated energy can be represented by an integral value thereof. Here, the energization current Ig is detected in the glow switch 2, and input to the electrical controlling unit 101.

That is, in this case, the accumulated energy Eg becomes $Eg=\int Vg(t)\times Ig(t)dt$. In addition, an integral time (integral period) is time between the energization start of the glow plug 1 and the time of determination of the driving transition condition.

In addition, it is preferable that the above-described predetermined value for determining whether or not the accumulated energy exceeds the driving transition condition value be specifically set to an appropriate value based on the test or the simulation result, depending on differences in the various conditions of each vehicle.

In addition, in the embodiment of the present invention, the detection of the energization current Ig does not need to be limited to a direct detection in the glow switch 2. A resistor for detection may be provided by being directly connected to a line through which the energization current Ig flows, a voltage drop may be input to the electrical controlling unit 101, and thus the energization current Ig may be obtained by converting the voltage drop into current.

Further, in step S206, if it is determined that the driving transition condition is satisfied (in a case of YES), the step proceeds to a process of step S208, the switching control signal is transferred from the electrical controlling unit 101 to the energization path switching switch 5, the first contact point 5*a* and the third contact point 5*c* are connected together, and the stability coil 3 becomes an open state. As a result, the battery voltage VB is applied to the glow plug 1 via the glow switch 2, the third contact point 5*c*, and the first contact point 5*a*. That is, in other words, a circuit connection becomes a normal connection state, and thereby energization driving of the glow plug 1 is performed. Thus, the current flowing through the glow plug 1 has a current waveform almost similar to the PWM signal as schematically illustrated in FIG. 3(B).

Next, a second configuration example will be described with reference to FIG. 4.

In addition, the same configuration elements as those illustrated in FIG. 1 are denoted by the same numerals and symbols, and detailed description thereof will be omitted. Hereinafter, the description will be focused on the differences therebetween.

Figure 4:
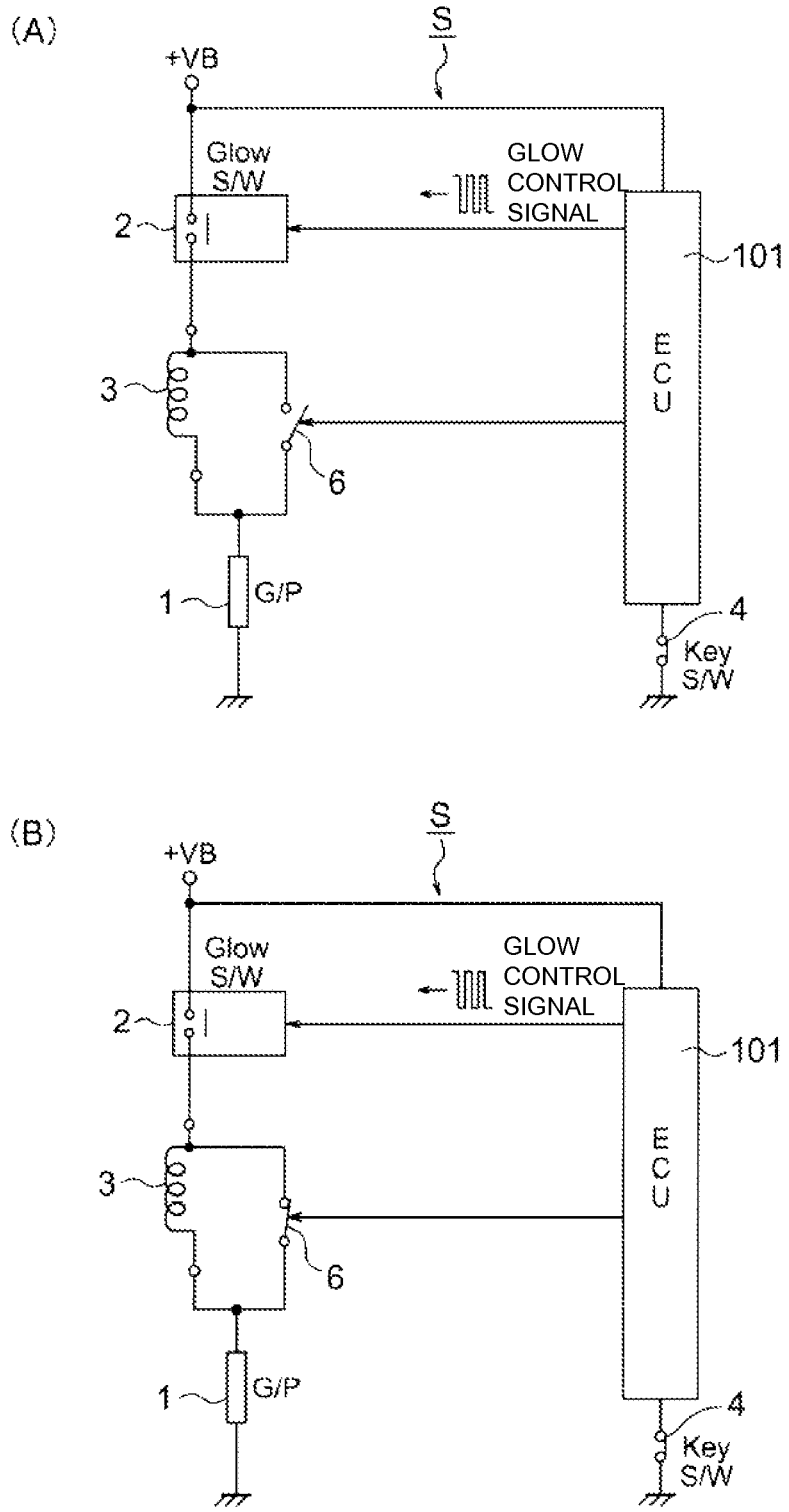
FIG. 4 is a circuit diagram illustrating a second circuit configuration example of a glow plug driving control apparatus according to an embodiment of the present invention.

In a configuration example illustrated in FIG. 4, the stability coil 3 and the energization path switching switch 6 which are in a state of being connected together in parallel are provided so as to be connected between the glow switch 2 and the glow plug 1.

That is, one terminal of the stability coil 3 and one terminal of the energization path switching switch 6 are connected together to one terminal of the glow switch 2, that is, one terminal on the opposite side of another terminal to which the supply voltage VB is applied, while the other terminal of the stability coil 3 and the other terminal of the energization path switching switch 6 are connected to one terminal of the glow plug 1, and the other terminal of the glow plug 1 is connected to the ground.

The energization path switching switch 6 in such a configuration example is a single pole single throw switch, that is, a one-circuit-one-contact-point switch, and configured by using a semiconductor element such as a field effect transistor as a main configuration element, for example.

Opening and closing of such an energization path switching switch 6 is controlled by the electrical controlling unit 101 in the same way as the energization path switching switch 5.

The energization path switching switch 6 according to the embodiment of the present invention becomes an opening state in a normal state, that is a state where any control signals are not applied from the outside (refer to FIG. 4(A)), while the energization path switching switch 6 is configured so as to become a closing state when a predetermined switching control signal is applied from the electrical controlling unit 101.

A glow plug driving control process performed by the electrical controlling unit 101 in such a configuration is basically the same as the process previously described with reference to FIG. 2, and thus description thereof will not be repeated again here.

In this way, the energization to the glow plug 1 is performed via the stability coil 3, only during a predetermined period of the energization start of the glow plug 1. Thus, a large momentary current is prevented from occurring at the time of the energization start of the glow plug 1, and unlike the related art, electrical stress with respect to the glow plug 1 is extremely reduced.

In addition, in the above-described embodiments according to the present invention, an example of using the PWM signal as the glow control signal is described, but it is not necessary to always be limited to the PWM signal, and other types of signals may be used.

In addition, a coil is used as a current stability element, but the current stability element need not be limited to the coil, and it is needless to say that other electronic components with the same characteristics may be used.

A large current can be prevented from occurring at the time of an energization start, and thus it is possible to apply to a glow plug driving control apparatus of a vehicle or the like in which relaxation of electrical stress caused by a large current is desired.

The invention claimed is:

1. A glow plug driving control apparatus, comprising:

a glow switch;

a glow plug connected in series with the glow switch, the glow switch and the glow plug connected between a power supply and ground;

an electrical controlling unit which controls opening and closing of the glow switch, and that can perform energization driving of the glow plug;

an energization path switching switch; and a current stability element;

wherein the energization path switching switch connects in series the current stability element in a serial connection path of the glow switch and the glow plug at the time of an energization start of the glow plug, wherein after the energization starts, the electrical controlling unit causes both the glow switch and the glow plug to return to a serial connection state between the power supply and the ground, wherein the energization path switching switch includes first, second, and third contact points, the first contact point is connected to one terminal of the glow plug, the second contact point is connected to one terminal of the current stability element, the third contact point is connected to both another terminal of the current stability element and one terminal of the glow switch, and another terminal of the glow plug is connected to the ground, while a supply voltage can be applied to another terminal of the glow switch, wherein the energization path switching switch is configured in such a manner that a connection state between the first contact point and the second contact point is maintained until a switching control signal is applied from the electrical controlling unit, and a connection state between the first contact point and the third contact point is made when the switching control signal is applied from the electrical controlling unit, and wherein the electrical controlling unit is configured in such a manner that the switching control signal is output to the energization path switching switch, when it is determined that a predetermined driving transition condition is satisfied, after the energization start of the glow plug, wherein the predetermined driving transition condition is an elapsed time from the energization start to the glow plug, and the electrical controlling unit is configured to determine that the predetermined driving transition condition is satisfied, when it is determined that the elapsed time previously set is reached, and wherein the electrical controlling unit is configured in such a manner that the previously set elapsed time is calculated, based on at least engine coolant temperature.

2. A glow plug driving control apparatus, comprising:

a glow switch;

a glow plug connected in series with the glow switch, the glow switch and the glow plug connected between a power supply and ground;

an electrical controlling unit which controls opening and closing of the glow switch, and that can perform energization driving of the glow plug;

an energization path switching switch; and a current stability element;

wherein the energization path switching switch connects in series the current stability element in a serial connection path of the glow switch and the glow plug at the time of an energization start of the glow plug, wherein after the energization starts, the electrical controlling unit causes both the glow switch and the glow plug to return to a serial connection state between the power supply and the ground, wherein the energization path switching switch includes first, second, and third contact points, the first contact point is connected to one terminal of the glow plug, the second contact point is connected to one terminal of the current stability element, the third contact point is connected to both another terminal of the current stability element and one terminal of the glow switch, and another terminal of the glow plug is connected to the ground, while a supply voltage can be applied to another terminal of the glow switch, wherein the energization path switching switch is configured in such a manner that a connection state between the first contact point and the second contact point is maintained until a switching control signal is applied from the electrical controlling unit, and a connection state between the first contact point and the third contact point is made when the switching control signal is applied from the electrical controlling unit, and wherein the electrical controlling unit is configured in such a manner that the switching control signal is output to the energization path switching switch, when it is determined that a predetermined driving transition condition is satisfied, after the energization start of the glow plug, and wherein the predetermined driving transition condition is an accumulated energy spent in the driving from the energization start of the glow plug, and the electrical controlling unit is configured to determine that the predetermined driving transition condition is satisfied, when it is determined that the accumulated energy reaches a predetermined value.

3. The glow plug driving control apparatus according to claim 2, wherein the accumulated energy is represented as $Vg^2 \times t$ by an application voltage Vg to the glow plug and an elapsed time t from the time of the energization start.

4. The glow plug driving control apparatus according to claim 2, wherein the accumulated energy is represented as $\int Vg(t) \cdot Ig(t) \cdot dt$ by an application voltage Vg to the glow plug, and an energization current Ig of the glow plug.

* * * * *